US005494565A

United States Patent [19]

Schenzel et al.

[11] Patent Number: 5,494,565

[45] Date of Patent: Feb. 27, 1996

[54] METHOD OF PRODUCING WORKPIECES OF NON-CORROSION-RESISTANT METALS WITH WEAR-RESISTANT COATINGS AND ARTICLES

[75] Inventors: Heinz-Guenther Schenzel; Thomas Engert, both of Heubach, Germany

[73] Assignee: Degussa Aktiengesellschaft, Frankfurt, Germany

[21] Appl. No.: 323,928

[22] Filed: Oct. 17, 1994

[30] Foreign Application Priority Data

Oct. 27, 1993 [DE] Germany ..... 43 36 664.3

[51] Int. Cl.[6] ..... C25D 3/58

[52] U.S. Cl. ..... 205/240; 205/241; 427/249; 427/255.1; 427/437

[58] Field of Search ..... 205/240, 241; 427/249, 255.1, 437

[56] References Cited

U.S. PATENT DOCUMENTS

| | | | |
|---|---|---|---|
| 1,970,549 | 8/1934 | Batten et al. | 204/2 |
| 4,036,602 | 7/1977 | Dean et al. | 428/621 |
| 4,557,980 | 12/1985 | Hodnett, III | 428/336 |
| 4,565,608 | 1/1986 | Hoffacker et al. | 204/44 |
| 4,605,474 | 8/1986 | Hoffacker et al. | 204/44 |
| 5,192,410 | 3/1993 | Ito et al. | 204/192.16 |

FOREIGN PATENT DOCUMENTS

| | | | |
|---|---|---|---|
| 2688234 | 9/1993 | France | C23C 30/00 |
| 4217612 | 12/1993 | Germany | C23C 4/04 |
| 90/02218 | 3/1990 | WIPO | C23C 28/00 |

OTHER PUBLICATIONS

Patent Abstracts of Japan, vol. 12, No. 446, English language abstract of JP 63 171 867.

Patent Abstracts of Japan, vol. 15, No. 496, English language abstract of JP 03 215 658.

Patent Abstracts of Japan, vol. 10, No. 310, English language abstract of JP 61 119 668.

"Ullmanns Encyklopädie der Technischen Chemie", 4th edition, vol. 12, pp. 190–194.

*Primary Examiner*—Benjamin Utech

*Attorney, Agent, or Firm*—Beveridge, DeGrandi, Weilacher & Young

[57] ABSTRACT

Workpieces of non-corrosion-resistant metals are provided with a wear-resistant, non-metallic layer of a nitride, carbide, boride, oxide or silicide of an element of the fourth to the sixth subgroup applied by PVD (physical vapor deposition) after a corrosion-resistant intermediate layer had been previously applied. An intermediate layer consisting of a copper-tin alloy with 45 to 80% copper, 10 to 55% tin and 0 to 15% zinc proved to be corrosion-resistant and noble and in addition does not cause any skin allergy.

14 Claims, No Drawings

METHOD OF PRODUCING WORKPIECES OF NON-CORROSION-RESISTANT METALS WITH WEAR-RESISTANT COATINGS AND ARTICLES

INTRODUCTION AND BACKGROUND

The present invention relates to a method of producing workpieces and objects fabricated from materials including non-corrosion-resistant metals and metal alloys which are coated with wear-resistant, non-metallic coatings of nitrides, carbides, borides, oxides or silicides of elements of the fourth to the sixth b subgroup of the Periodic Table of Elements and in which a corrosion-resistant intermediate layer is arranged between the workpiece surface and the wear-resistant, non-metallic coating. In another aspect, the present invention relates to the articles having improved properties.

Workpieces and objects formed of metals and metal alloys exhibiting little resistance to corrosion are increasingly provided for technical and decorative applications with hard, wear-resistant and in some instances also decorative coatings of nitrides, carbides, borides, oxides and silicides of elements of the fourth to the sixth b subgroup of the periodic table such as e.g. titanium, zirconium, vanadium, niobium, tantalum, chromium, molybdenum or tungsten. The application of these coatings takes place in accordance with the so-called PVD method (physical vapor deposition) which is well known in the art (see, for example, Kirk-Other's *Encyclopedia of Chemical Technology,* Third Edition, Volume 20, pages 42–47 and Volume 23, pages 295–299; these excerpts are entirely incorporated herein by reference). Coatings of titanium nitride and titanium carbide are preferred. As used herein, the expression "PVD" coating or layer is intended to refer to these known coatings or claddings.

However, the coatings produced in this manner have the disadvantage that they are brittle, porous and form microcracks. These layers exhibit a high so-called pinhole density due to their columnar growth. As a result, they do not offer good corrosion protection for the material thereunder, especially since these layers behave in an electrochemically inert manner so that the baser substrata are corrosively dissolved.

DE 38 09 139 (GB 2,218,111) teaches the arranging of a corrosion-resistant, dense layer of a palladium-nickel alloy between the workpiece surface and the PVD coating. This layer prevents the attack of corrosion through the porous PVD coating of the non-corrosion-resistant material of the foundation. In addition, a palladium-nickel layer has the advantage that it is almost as noble as the PVD layer and is therefore also barely attacked electrochemically. However, such layers have the disadvantage that they contain nickel which can act as an initiator of allergies. Palladium can also initiate allergies in some instances. Thus there was a need to avoid nickel and, if possible, palladium as alloy components for objects and workpieces which can come in contact with human skin.

DE 42 17 612, which is not a prior publication, describes metallic workpieces and their production which are provided with a corrosion-resistant underlayer of copper-tin alloys and with a wear-resistant upper layer consisting of metals such as chromium steel, molybdenum or manganese, or oxides, carbides or materials containing other hard substances. They are applied exclusively by means of thermal spraying methods such as flame spraying.

The use of galvanically applied copper-tin alloys as corrosion-resistant coatings is also known from "Ullmanns Encyklopädie der Technischen Chemie", 4th edition, volume 12, pages 190–194.

SUMMARY OF THE INVENTION

An object of the present invention therefore was to develop a method of producing workpieces and objects of non-corrosion-resistant metals and metal alloys which are coated or cladded with wear-resistant, non-metallic coatings of nitrides, carbides, borides, oxides or silicides of elements of the fourth to the sixth b subgroup of the Periodic Table of Elements and in which a corrosion-resistant intermediate layer is arranged between the workpiece surface and the wear-resistant, non-metallic coating, which intermediate layer should be free of nickel and palladium, should exhibit an electrochemical potential comparable to the wear-resistant, non-metallic layer, and be corrosion-resistant. In addition, this intermediate layer should be able to be separated out of galvanic baths and exhibit a leveling action.

Another object of the present invention is to provide workpieces and other metallic objects and articles of improved properties.

In achieving the above and other objects, one feature of the present invention resides in a method where at first an intermediate layer of a copper-tin alloy with 45 to 80% by weight copper, 10 to 55% by weight tin and 0 to 15% by weight zinc is galvanically applied onto the surface of the workpieces or objects formed from non-corrosion resistant metals and metal alloys and subsequently the wear-resistant, non-metallic layer is applied by means of the PVD method.

DETAILED DESCRIPTION OF THE INVENTION

According to a more detailed aspect of the invention, it is preferable to apply the copper-tin alloys as the intermediate layer which consist of 45 to 65% by weight copper and 35 to 55% by weight tin or of 50 to 80% by weight copper, 10 to 35% by weight tin and 1 to 15% by weight zinc.

These intermediate layers are very corrosion-resistant and exhibit an electrochemical potential which comes close to that of brass alloys and bronze alloys which are frequently used as underlayer materials. Moreover, they exhibit a high degree of hardness of approximately 600 HV and therefore offer a good transition between the PVD applied layers (1000–1500 HV) and the underlayer material. In contrast, softer intermediate layers such as palladium-nickel tend to result in a flaking off of the PVD layers upon mechanical stressing.

Copper-tin alloy layers can be galvanically deposited economically on practically all metallic substrate materials yielding bonded layers with uniform layer thicknesses even if the underlying substrate is of complicated geometry. Baths like those described in DE 33 39 541 (U.S. Pat. Nos. 4,565,608 and 4,605,474) have proven themselves for this purpose. They contain 1 to 60 g/l copper as copper cyanide, 7 to 30 g/l tin in the form of alkali stannate (e.g., sodium stannate or potassium stannate), 0.1 to 100 g/l of a complexing agent, 1 to 50 g/l free alkali cyanide (e.g., sodium cyanide or potassium cyanide), 1 to 50 g/l alkali hydroxide (e.g., sodium hydroxide or potassium hydroxide), up to 50 g/l alkali carbonate (e.g., sodium carbonate or potassium carbonate) and 0.05 to 5 g/l of an organic fatty acid compound or of a naphthol. Complexing agents, organic fatty acid compounds and naphthols are described in U.S.

Pat. Nos. 4,565,608 and 4,605,474. All these details of galvanic deposition are known in the art and the selection of specific conditions will be apparent to those skilled in the art (see, for example, Kirk-Other's *Encyclopedia of Chemical Technology,* Third Edition, Volume 8, pages 826–869, this excerpt is entirely incorporated herein by reference; U.S. Pat. Nos. 4,565,608 and 4,605,474 are incorporated by reference in their entirety, especially for their teachings of alkaline cyanide baths).

Practically all metallic substrate materials such as e.g. aluminum, copper, steel, zinc, nickel and aluminum-nickel alloys, copper-nickel alloys, nickel alloys and metallized plastics can be coated therewith. The most preferable substrate material to be used is brass.

The intermediate layers are preferably applied with a layer thickness between 0.1 and 10 μm.

In addition to assuring corrosion protection, the copper-tin layers or copper-tin-zinc layers can also assume the function of leveling and formation of luster. A copper-tin-zinc layer is preferably used to achieve leveling and formation of luster. The term "leveling" and "luster" are well understood in the art. Usually, acidic copper electrolytes are otherwise used for the leveling and formation of luster of rack goods. In the case of drum or barrel goods only a leveling but no formation of luster can be achieved with the acidic copper electrolytes. A leveling and formation o:f luster is possible both in the case of rack goods and also of drum goods with an electrolyte for depositing copper-tin-zinc Layers.

In order to improve the binding of the layer of hard material applied by PVD methods to the copper-tin intermediate layer or the copper-tin-zinc intermediate layer, the intermediate layers of copper-tin or of copper-tin-zinc can be galvanically coated with a layer of precious metals 0.1 μm thick. Conditions to accomplish this will be known to those skilled in the art.

The following examples are intended to explain the method of the invention in detail:

EXAMPLE 1

Polished steel buttons are precleaned in an aqueous, alkaline manner as is known in the art, electrolytically defatted according to known procedures, pickled in a known way in a mineral acid and galvanically coated with a copper-tin layer with differing layer thicknesses (1 μm, 2 μm, 3 μm, 5 μm). The layers are then checked with the ferroxyl test and with the dimethylglyoxim test for pores. These tests are known in the art. After a layer thickness of 3 μm neither of the two solutions produces a discoloration of the surfaces, that is, they demonstrate no pores. Galvanic baths are used to deposit the copper-tin layers (55 Cu, 45 Sn), the baths contain 5 to 10 g/1 copper as copper cyanide, 15 to 30 g/1 tin as stannate, 30 to 50 g/1 potassium cyanide, and 5 to 25 g/1 potassium hydroxide. The deposition took place at 50° to 60° C. with current strengths of 2 to 4 A/dm$^2$.

EXAMPLE 2

Polished brass sheets are treated in a conventional way; i.e., precleaned in an aqueous, alkaline manner, electrolytically defatted, and pickled in a mineral acid. They are then directly coated galvanically with a copper-tin layer 3 μm thick in accordance with example 1. The coated sheets are then subjected to a Kesernich test (DIN (German Industrial Standard) 50018) of 5 rounds with 0.2 1 $SO_2$. The layers exhibit no attack by corrosion either on the surface (REM photograph) or in a polish of the cross-section.

EXAMPLE 3

Brass sheets and brass casings are precleaned in an aqueous, alkaline manner, electrolytically defatted, and pickled in a mineral acid as is known in the art. Then they are coated galvanically with a copper-tin-zinc layer 10 μm thick (60 Cu, 35 Sn, 5 Zn) for leveling and formation of luster. A 3 μm thick copper-tin layer (55 Cn, 45 Sn) is applied onto this layer as a functional corrosion protection layer. Then the coated sheets are subjected to a Kesternich test (DIN 50018) of 5 rounds with 0.2 1 $SO_2$ as in example 2. The layers exhibit no corrosion attack as in example 2.

Further variations and modifications of the foregoing will be apparent to those skilled in the art and such variations and modifications are attended to be encompassed by the claims that are appended hereto.

German Priority Application P 43 36 664.3, filed on Oct. 27, 1993, is noted for background.

What is claimed is:

1. A method of producing a workpiece or object fabricated of a metal, metal alloy or mixture thereof, said method comprising galvanically applying to a surface of said workpiece or object an intermediate layer of a copper-tin alloy consisting essentially of 45 to 80% by weight copper, 10 to 55% by weight tin, and 0 to 15% by weight zinc, and subsequently applying thereto a non-metallic coating of a member selected from the group consisting of a nitride, carbide, boride, oxide or silicide of an element of the fourth to the sixth b subgroup of the Periodic Table of Elements, and mixtures thereof, in which said intermediate layer is arranged between said surface of said workpiece or object and said non-metallic coating.

2. The method according to claim 1, wherein said copper-tin alloy is 45 to 65% by weight copper and 35 to 55% by weight tin.

3. The method according to claim 1, wherein said copper-tin alloy is 50 to 80% by weight copper, 10 to 35% by weight tin and 1 to 15% by weight zinc.

4. The method according to claim 1, wherein said intermediate layer has a hardness of 600 HV.

5. The method according to claim 1, wherein said intermediate layer has a thickness of 0.1 to 10 μm.

6. The method according to claim 1, further comprising overcoating said intermediate layer with precious metal.

7. The method according to claim 6, wherein said precious metal is gold.

8. The method according to claim 1, wherein said galvanically applying comprises using a galvanic bath which consists essentially of 1 to 60 g/l copper as copper cyanide, 7 to 30 g/l tin in the form of alkali stannate, 0.1 to 100 g/l of a complexing agent, 1 to 50 g/l free alkali cyanide, 1 to 50 g/l alkali hydroxide, up to 50 g/l alkali carbonate, and 0.05 to 5 g/l of an organic fatty acid compound or of a naphthol.

9. The method according to claim 8, wherein said galvanic bath is at 50° to 60° C. and 2 to 4 A/dm$^2$.

10. The method according to claim 1, wherein said metal or metal alloy of said workpiece or object is selected from the group consisting of brass, aluminum, copper, steel, zinc, nickel, aluminum-nickel alloy, copper-nickel alloy, and nickel alloy.

11. The method according to claim 10, wherein said alloy is brass.

12. The method according to claim 1, wherein said, non-metallic coating is titaniuim nitride or titanium carbide.

13. The method according to claim 1, wherein said copper-tin alloy consists of 45 to 80% by weight copper, 10 to 55% by weight tin, and 0 to 15% by weight zinc.

14. The method according to claim 1, wherein said method consists essentially of galvanically applying to a surface of said workpiece or object an intermediate layer of a copper-tin alloy consisting essentially of 45 to 80% by weight copper, 10 to 55% by weight tin, and 0 to 15% by weight zinc, and subsequently applying thereto a non-metallic coating of a member selected from the group consisting of a nitride, carbide, boride, oxide or silicide of an element of the fourth to the sixth b subgroup of the Periodic Table of Elements, and mixtures thereof, in which said intermediate layer is arranged between said surface of said workpiece or object and said non-metallic coating; and optionally overcoating said intermediate layer with precious metal.

* * * * *